US011052410B2

(12) United States Patent
Blattner et al.

(10) Patent No.: US 11,052,410 B2
(45) Date of Patent: Jul. 6, 2021

(54) SANITARY SHOWER DEVICE

(71) Applicant: Hansgrohe SE, Schiltach (DE)

(72) Inventors: Joachim Blattner, Haslach (DE); Jürgen Groß, Mühlenbach (DE)

(73) Assignee: Hansgrohe SE, Schiltach (DE)

( * ) Notice: Subject to any disclaimer, the term of this patent is extended or adjusted under 35 U.S.C. 154(b) by 109 days.

(21) Appl. No.: 16/521,508

(22) Filed: Jul. 24, 2019

(65) Prior Publication Data

US 2020/0030826 A1 Jan. 30, 2020

(30) Foreign Application Priority Data

Jul. 25, 2018 (DE) ..... 10 2018 212 408.6

(51) Int. Cl.
*B05B 1/18* (2006.01)
*B05B 1/34* (2006.01)
*B05B 1/16* (2006.01)

(52) U.S. Cl.
CPC ..... *B05B 1/18* (2013.01); *B05B 1/1636* (2013.01); *B05B 1/34* (2013.01)

(58) Field of Classification Search
CPC ..... B05B 1/16; B05B 1/1636; B05B 1/169; B05B 1/18; B05B 1/185; B05B 1/34; B05B 12/002; B05B 12/02; E03C 1/02
See application file for complete search history.

(56) References Cited

U.S. PATENT DOCUMENTS 5,246,301 A 9/1993 Hirasawa
8,807,461 B2 * 8/2014 Blattner ..... B05B 1/185 239/557
2013/0186972 A1 7/2013 Petrovic
2014/0014743 A1 1/2014 Schorn et al.
2014/0319248 A1 10/2014 Kinle
2016/0107175 A1 4/2016 Kinle
(Continued)

FOREIGN PATENT DOCUMENTS

CN 201930857 U 8/2011
CN 105592932 A 5/2016
(Continued)

OTHER PUBLICATIONS

European Search Report (in German language) issued by the German Patent Office, dated Nov. 20, 2019, for European Patent Application No. 19187582.2; 8 pages.
(Continued)

*Primary Examiner* — Darren W Gorman
(74) *Attorney, Agent, or Firm* — Bose McKinney & Evans LLP

(57) ABSTRACT

A sanitary shower device including a shower body including a fluid inlet configuration, a jet disk and an interposed fluid guidance, wherein jet output elements of the jet disk each have a first and a second fluid input opening and discharge fluid supplied via the first fluid input openings as a first shower jet with a first jet pattern and fluid supplied via the second fluid input openings as a second shower jet with a second jet pattern differing from the first jet pattern, a fluid control device including a fluid outlet connection configuration and a user-operated fluid control unit, and a fluid conduit configuration for fluid coupling of the fluid inlet configuration to the fluid outlet connection configuration.

9 Claims, 2 Drawing Sheets

(56) References Cited

U.S. PATENT DOCUMENTS

| | | | | |
|---|---|---|---|---|
| 2016/0332173 | A1* | 11/2016 | Butzke | B05B 1/06 |
| 2017/0128960 | A1 | 5/2017 | D'Urso et al. | |

FOREIGN PATENT DOCUMENTS

| | | | |
|---|---|---|---|
| CN | 106563581 | A | 4/2017 |
| DE | 102013207687 | A1 | 10/2014 |
| EP | 3153237 | B1 | 2/2020 |
| GB | 2500899 | A | 10/2013 |
| RU | 2162373 | C1 | 1/2001 |
| RU | 2013131448 | A | 1/2015 |
| RU | 161450 | U1 | 4/2016 |

OTHER PUBLICATIONS

Decision on Granting issued by the Federal Service for Intellectual Property, Patents and Trademarks (ROSPATENT) dated Nov. 19, 2019, with English language translation, for Russian Patent Application No. 2019122395/05 (043761);18 pages.

Office Action issued by the National Intellectual Property Administration, P.R. China, dated Oct. 12, 2020 for Chinese Patent Application No. 201910677133.5, 9 pages.

Office Action issued by the German Patent and Trademark Office, dated Mar. 8, 2019, for German Patent Application No. DE 10 2018 212 408.6.

* cited by examiner

SANITARY SHOWER DEVICE

CROSS-REFERENCE TO RELATED APPLICATION

This application claims priority to German Patent Application No. DE 10 2018 2124 08.6, filed on Jul. 25, 2018, the disclosure of which is expressly incorporated herein by reference.

BACKGROUND AND SUMMARY OF THE DISCLOSURE

The disclosure relates to a sanitary shower device which illustratively includes a shower body including a fluid inlet configuration on an input side, a jet disc on an output side having a plurality of jet output elements and a fluid guidance from the fluid inlet configuration to the jet disc, wherein the jet output elements each have a first and a second fluid input opening and are configured to discharge fluid supplied by the first fluid input openings as a first shower jet with a first jet pattern and fluid supplied via the second fluid input openings as a second shower jet with a second jet pattern differing from the first jet pattern.

In corresponding illustrative embodiments, the jet output elements are disposed distributed over the entire fluid-output-active surface of the jet disc, preferably in a uniform distribution, and/or the jet disc exclusively has this and no other jet output elements forming the shower jet. The distance between the two fluid input openings of each jet output element is typically smaller than the minimum distance between in each case two fluid input elements of two jet output elements which are the closest adjacent; the distance is preferably at most half or a third as large as the latter.

As is familiar to a person skilled in the art, the jet patterns of the shower jets can differ, for example, in the main jet direction of the shower jet and/or in the degree of convergence or divergence of the shower jet. The main jet direction should be understood here, as customary, as meaning that direction in which the shower jet mainly expands, even if it is composed, for example, of non-parallel individual jets and it forms, for example, a converging shower jet, in which the individual jets emerging from the jet output elements converge with one another, or a diverging shower jet, in which the individual jets run away from one another. The main jet direction typically runs parallel to or at a small angle of generally no more than 20° to 25°, in rarer cases 25° to 45°, obliquely to a normal direction or longitudinal direction of the jet disc or of an output-side end surface of same. It goes without saying that the explicit specification of the first and second shower jet does not mean that the invention is restricted to the provision of only two different shower jets. On the contrary, in corresponding embodiments, one or more further shower jets each having different jet patterns can be provided, in particular by supply of the fluid simultaneously to the two fluid input openings of the respective jet output element in preferably variably changeable amounts.

Furthermore, the presently considered sanitary shower device illustratively includes a fluid control device disposed spatially separated from the shower body, including a fluid outlet connection configuration and a user-operated fluid control unit for controlling a fluid supply to the fluid outlet connection configuration, and a fluid conduit configuration for fluid coupling of the fluid inlet configuration of the shower body to the fluid outlet connection configuration of the fluid control device. Fluid control devices of this type are conventionally used, for example, in the form of thermostatic fittings to which cold water and hot water are supplied on the inlet side via separate inlets and which provide the supplied cold water and hot water in a desired mixing ratio at a mixing water outlet connector as the fluid outlet connector configuration. For this purpose, the thermostatic fitting conventionally has a quantity control unit and a thermostatic or mixer unit as the user-operated fluid control unit. In these conventional embodiments, a rigid or flexible pipe/hose conduit serves as the fluid conduit configuration for coupling the fluid inlet configuration of the shower body to the mixing water outlet connector of the thermostatic fitting.

Laid-open publication DE 10 2013 207 687 A1 discloses a shower body which is usable for such a conventional sanitary shower device and which accordingly has a single fluid inlet as the fluid inlet configuration. Furthermore, this shower body includes a jet disc on an output side having a plurality of jet output elements and a fluid guidance from the fluid inlet to the jet disc, wherein the jet output elements each have a first and a second fluid input opening and are configured to discharge fluid supplied via the first fluid input openings as a first shower jet with a first jet pattern and fluid supplied via the second fluid input openings as a second shower jet with a second jet pattern differing from the first jet pattern. Specifically, the jet output elements there are designed as V-shaped passage openings which extend through the jet disc conically tapering in the output direction and respectively provide the two fluid input openings on the input side and a fluid output opening on the output side that is shared by the two fluid input openings. A control disc is arranged rotatably on the inner side of the jet disc, which control disc can be driven by the supplied fluid by means of a turbine blade structure and has a control slot pattern in order periodically to open up or to shut off the fluid input openings of the jet outlet elements. By means of a manually operable blocking mechanism, the rotational movement of the control disc can either be opened up or blocked in at least one blocking position which corresponds to an associated jet pattern of the discharged shower jet.

Laid-open publication US 2013/0186972 A1 discloses a shower body in which the jet output elements are formed by output nipples of elastic material which are held movably in jet disc openings and to which a user-operable displacement element is assigned, by means of which the user can shift the output nipples and can thereby set shower jets having a different jet pattern and in particular having a different main jet direction.

It is an object of the invention to provide a sanitary shower device of the type mentioned at the outset with which the different shower jets can be provided or can be selected/set by the user in a particularly comfortable manner in comparison with the prior art explained above.

The invention achieves this and other objects by providing a sanitary shower device having novel and advantageous features as follows.

In detail, the illustrative sanitary shower device includes a shower body including a fluid inlet configuration on an input side, a jet disk on an output side having a plurality of jet output elements and a fluid guidance from the fluid inlet configuration to the jet disk, wherein the jet output elements each have a first and a second fluid input opening and are configured to discharge fluid supplied via the first fluid input openings as a first shower jet with a first jet pattern and fluid supplied via the second fluid input openings as a second shower jet with a second jet pattern differing from the first jet pattern. The illustrative sanitary shower device further includes a fluid control device disposed spatially separated from the shower body, including a fluid outlet connection configuration and a user-operated fluid control unit for controlling a fluid supply to the fluid outlet connection configuration, and a fluid conduit configuration for fluid coupling of the fluid inlet configuration of the shower body to the fluid outlet connection configuration of the fluid control device.

In the illustrative sanitary shower device, the fluid inlet configuration of the shower body includes a first shower body inlet and a second shower body inlet separated from the first one. The fluid guidance within the shower body includes two separate fluid flow paths, of which a first fluid flow path connects the first fluid input openings of the jet output elements with the first shower body inlet and a second fluid flow path connects the second fluid input openings of the jet output elements to the second shower body inlet. The fluid outlet connection configuration of the fluid control device includes a first outlet connector and a second outlet connector separated from the first one. The fluid conduit configuration includes a first fluid conduit from the first outlet connector of the fluid outlet connection configuration to the first shower body inlet and a second fluid conduit from the second outlet connector of the fluid outlet connection configuration to the second shower body inlet. The fluid control unit includes a user-operated distributor element for variable forwarding of supplied fluid to the first outlet connector and/or to the second outlet connector of the fluid outlet connection configuration of the fluid control device.

The illustrative sanitary shower device designed in such a way makes it possible for the user to select either the first shower jet or the second shower jet by the fact that, by operating the distributor element of the fluid control unit on the fluid control device, the user forwards the supplied fluid to the first and/or to the second outlet connector of the fluid control device. Consequently, for changing between the shower jets, it is sufficient for the distributor element of the fluid control unit on the fluid control device, which is disposed spatially separated from the shower body, to be accessible for the user. By contrast, access of the user to the shower body itself is not required.

This has the advantage, for example, that the user can change the sanitary shower device between the different shower jets even if the shower body is not accessible for the user or at any rate is not readily reachable. This may be the case, for example, in ceiling-mounted overhead showers in high shower rooms if the shower body or shower head is located there at a height which is not reachable for the user without aids. By contrast, in shower rooms of this type, a fluid control device, for example in the form of a thermostatic fitting or a mixer fitting and/or shut-off fitting, is customarily in any case already provided in the gripping region of the user and can then easily be retrofitted or equipped to form the fluid control device required for the sanitary shower device according to the invention. Alternatively, the fluid control device for the sanitary shower device according to the invention with the user-operated distributor element for variably forwarding supplied fluid to the first and/or to the second outlet connector and with the corresponding fluid outlet connection configuration as an independent component of the sanitary shower device can be arranged in a suitable access region for the user.

It goes without saying that any of the designs which are known per se for this purpose to a person skilled in the art are suitable for the user-operated distributor element, wherein the user operation can likewise be of any conventional type, for example a mechanical operation, a touch operation, an electrical or an electronic activation operation, including the possibility of a remote-controlled operation, in which the fluid control device itself does not necessarily have to be positioned in the gripping region or accessible region of the user.

When the user forwards the fluid supplied to the fluid control device only to the first outlet connector by means of the distributor element, the shower body discharges the first shower jet. If the user forwards the fluid only to the second outlet connector via the distributor element, the shower body discharges the second shower jet. In corresponding embodiments, the distributor element permits forwarding of the supplied fluid in preferably controllable amounts both to the first and to the second outlet connector of the fluid control device. For this situation, the shower body can be configured if desired in such a manner that it outputs a shower jet formed by superimposition or interaction of the fluid supplied to the first fluid input opening of the respective fluid output element with the fluid supplied to the second fluid input element, referred to here as a combined shower jet. For example, the shower body can discharge the combined shower jet with a degree of convergence/divergence or a main jet direction which lies between the degree of convergence/divergence or the main jet direction of the first shower jet and the degree of convergence/divergence or the second main jet direction of the second shower jet, wherein, in addition, the respective degree of convergence/divergence or the respective main jet direction of the combined shower jet can be dependent on the amounts by which the user forwards the fluid by means of the distributor element to the first and to the second outlet connector of the fluid control device, respectively, and therefore to the first and second fluid input openings of the jet output elements of the shower body, respectively.

In a development of the invention, the user-operated distributor element is a three-way distributor valve element. Such valve elements, also called two-channel volume regulators, are known per se, which therefore does not require any more detailed explanations here, and are advantageously suitable to distribute a fluid supplied via an entry channel in preferably controllably variable amounts to two separate exit channels.

In a development of the invention, the shower body is an overhead shower body configured for installation on a wall or ceiling of a shower room. The sanitary shower device is therefore suitable as an overhead shower in a shower room.

In a development of the invention, the fluid control device includes a mixer and/or shut-off fitting and the fluid control unit correspondingly includes a mixing and/or shut-off valve unit. Such mixer and/or shut-off fittings or mixing and/or shut-off valve units are known per se and, in this sanitary shower device, are advantageously combined with the user-operated distributor element for variably forwarding supplied fluid to the first and/or to the second outlet connector of the fluid control device.

In a development of the invention, the jet output elements are designed as V-shaped passage openings which extend through the jet disc conically tapering in the output direction and respectively provide the two fluid input openings on the input side and a fluid output opening on the output side that is shared by both the fluid input openings. This constitutes a realization of the jet output elements of the jet disc that is advantageous in terms of manufacturing and functionality. The mutually inclined flanks of the V shape of the passage openings can serve here as guiding surfaces in order to discharge the shower jet in each case with a corresponding main jet direction. In addition, this configuration of the jet output elements when required also permits the production of a combined shower jet in which the fluid amounts passing into the jet output element via the first or the second fluid input opening are superimposed or interact in their flow directions defined by the V flanks. In alternative embodiments, the respective jet output element includes two separate fluid output openings, each of which corresponds to in each case one of the two fluid input openings with two separate, closely adjacent passage openings being formed, wherein the passage openings can be formed, for example, as separate bores in the jet disc and preferably run in an inclined manner with respect to one another, i.e. obliquely with respect to one another.

In a refinement of the invention, the sanitary shower device includes an intermediate plate upstream of the jet disc in the output direction, which plate has V-shaped projections corresponding to the V-shaped passage openings of the jet output elements, which projections extend from the two fluid input openings to the fluid output opening into the V-shaped passage openings, thereby leaving a respective fluid channel. This constitutes a realization which is advantageous in terms of manufacturing and functionality for the two fluid input openings and the common fluid output opening of the respective jet output element and for the fluid guidance in the jet output element from the two fluid input openings to the common fluid output opening.

In a development of the invention, the sanitary shower device includes a chamber plate upstream of the jet disc in the output direction, one plate side of the plate delimiting a first fluid chamber as part of the first fluid flow path and a second fluid chamber being provided in the interior thereof as part of the second fluid flow path, wherein the chamber plate includes connecting channels leading from the second fluid chamber to the second fluid input openings. This constitutes a realization which is advantageous in terms of manufacturing and functionality for the fluid guidance in the shower body from the fluid inlet configuration to the jet disc and in particular for the two separate fluid flow paths in the shower body from the first shower body inlet to the first fluid input openings or from the second shower body inlet to the second fluid input openings. In addition, this structural design of the fluid guidance in the shower body permits a comparatively compact structural form of the shower body if required.

In a refinement of the invention, the plate side which delimits the first fluid chamber is a plate side of the chamber plate facing away from the jet disc and the chamber plate includes passage channels leading from the first fluid chamber through the chamber plate to the first fluid input openings. This structural measure is also of advantage in terms of manufacturing and functionality and also in respect of obtaining a compact constructional form.

In a development of the invention, the fluid inlet configuration is disposed on an exterior side of the shower body facing away from the jet disc. This can be of advantage in particular in terms of flow since relatively great fluid deflections in the shower body can therefore be avoided if required.

In a development of the invention, the first and the second shower body inlets are arranged coaxially, wherein the first shower body inlet surrounds the other shower body inlet coaxially. This realization of the fluid inlet configuration of the shower body on the input side can, if required, facilitate a correspondingly coaxial design of the upstream fluid conduit configuration and also a compact constructional form of the shower body.

Additional features and advantages of the present invention will become apparent to those skilled in the art upon consideration of the following detailed description of the illustrative embodiments best exemplifying the best mode of carrying out the invention as presently perceived.

BRIEF DESCRIPTION OF THE DRAWINGS

Advantageous embodiments of the invention are illustrated in the drawings. These and further embodiments of the invention are described in greater detail below. In the drawings.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
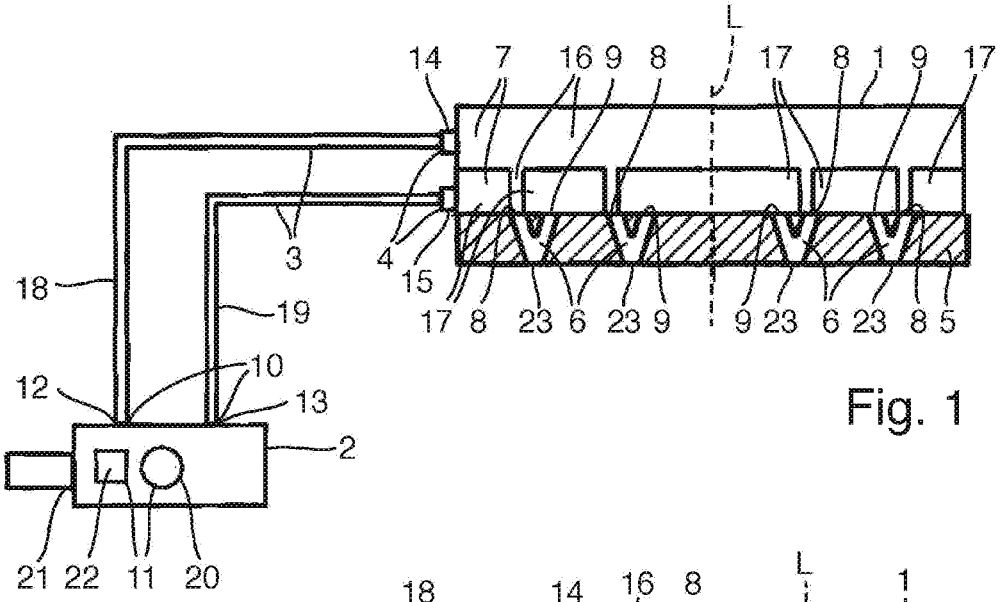
FIG. 1 shows a schematic block illustration of a sanitary shower device without supplied fluid.
Figure 2:
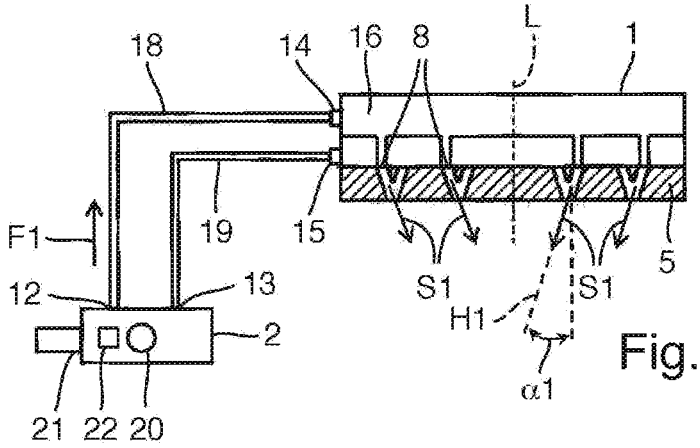
FIG. 2 shows the view of FIG. 1 in the state when discharging a first shower jet.
Figure 3:
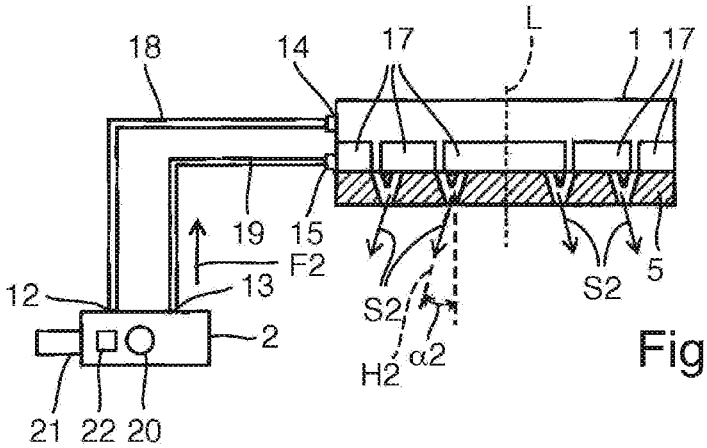
FIG. 3 shows the view of FIG. 1 in the state when discharging a second shower jet.

The illustrative sanitary shower device shown schematically in FIGS. 1 to 3 includes a shower body 1, a fluid control device 2 arranged in a spatially separated manner from the shower body 1 and a fluid conduit configuration 3 leading from the fluid control device 2 to the shower body 1.

The illustrative shower body 1 includes a fluid inlet configuration 4 on an input side, a jet disc 5 on an output side having a plurality of jet output elements 6 and a fluid guidance 7 from the fluid inlet configuration 4 to the jet disc 5. The jet output elements 6 each have a first fluid input opening 8 and a second fluid input opening 9 and are configured to discharge fluid supplied via the first fluid input openings 8 as a first shower jet with a first jet pattern S1 and fluid supplied via the second fluid input openings 9 as a second shower jet with a second jet pattern S2 differing from the first jet pattern S1.

The fluid control device 2 includes a fluid outlet connection configuration 10 and a user-operated fluid control unit 11 for controlling a fluid supply to the fluid outlet connection configuration 10. The fluid outlet connection configuration 10 of the fluid control device 2 includes at least one first outlet connector 12 and a second outlet connector 13 separated from the first one.

The fluid inlet configuration 4 of the shower body 1 includes at least one first shower body inlet 14 and a second shower body inlet 15 separated from the first one. In a manner matched thereto, the fluid guidance 7 within the shower body 1 includes two separate fluid flow paths 16, 17, of which a first fluid flow path 16 connects the first fluid input openings 8 with the first shower body inlet 14 and a second fluid flow path 17 connects the second fluid input openings 9 with the second shower body inlet 15.

The illustrative fluid conduit configuration 3 illustratively includes a first fluid conduit 18 from the first outlet connector 12 of the fluid outlet connection configuration 10 to the first shower body inlet 14 and a second fluid conduit 19 from the second outlet connector 13 of the fluid outlet connection configuration 10 to the second shower body inlet 15.

The fluid control unit 11 includes a user-operated distributor element 20 for variable forwarding of supplied fluid to the first outlet connector 12 and/or to the second outlet connector 13.

The fluid which can be in particular water can be supplied to the fluid control device 2 and therefore to the fluid control unit 11 via a conventional fluid supply configuration 21 which includes one or more separate fluid inlets.

FIG. 2 shows the situation when the fluid supplied to the fluid control unit 11 is forwarded via the user-operated distributor element 20 only to the first outlet connector 12, but not to the second outlet connector 13. This results in a fluid flow F1 exclusively in the first fluid conduit 18, as a result of which the fluid is supplied via the first shower body inlet 14 and the first fluid flow path 16 exclusively to the first fluid input openings 8 of the jet output elements 6 which, as a consequence thereof, discharge the first shower jet having the first jet pattern S1.

FIG. 3 shows the situation when the user has set the distributor element 20 in such a manner that the fluid supplied to the fluid control device 2 is forwarded only to the second outlet connector 13, but not to the first outlet connector 12. The fluid then passes as a fluid flow F2 exclusively via the second fluid conduit 19 and the second shower body inlet 15 to the second fluid flow path 17 of the fluid guidance 7 in the shower body 1 and from there exclusively to the second fluid input openings 9 and not to the first fluid input openings 8 of the shower output elements 6. In this case, the jet output elements 6 and therefore the shower body 1 discharge the fluid as the second shower jet having the second jet pattern S2.

In optional embodiments of the distributor element 20 and of the shower body 1, the fluid can be supplied in divided form both to the first fluid input openings 8 and to the second fluid input openings 9 of the jet output elements 6, preferably in variably controllable amounts by means of the distributor element 20. In this case, the sanitary shower device can discharge a combined shower jet on the output side of the shower body 1, the combined shower jet arising by superimposition or interaction of the two fluid flows in the respective jet output element 6, the fluid flows entering into the latter via the first or via the second fluid input opening 8, 9.

In the exemplary embodiment shown in FIGS. 1 to 3, the first shower jet having the jet pattern S1 is a convergent shower jet in which, consequently, the individual jets emerging from the individual jet output elements 6 converge toward one another in the jet output direction, i.e. a main jet direction H1 of the individual jets of the first shower jet runs inclined inwards at an oblique angle $\alpha 1$ to a longitudinal axis direction L of the shower body 1, i.e. in the direction of the longitudinal centre of the shower body. The second shower jet having the jet pattern S2 is a diverging shower jet in which the individual jets forming the second jet pattern S2 run away from one another in the jet output direction, i.e. a main jet direction H2 of the individual jets runs inclined outwards at an oblique angle $\alpha 2$ to the longitudinal axis direction L of the shower body 1, i.e. away from the longitudinal centre of the shower body 1. In alternative embodiments, the first and the second shower jet have different jet patterns, for example, in one of the jet patterns, the individual jets can run substantially parallel to the longitudinal axis direction L of the shower body 1, or all of the individual jets run parallel to one another inclined in a same direction to the longitudinal axis direction L of the shower body 1, for example all are inclined to the left or all to the right in FIG. 2.

The main jet directions H1, H2 of the individual jets for the first and the second shower jet can be suitably defined by an appropriate configuration of the shower body 1 and in particular of the jet disc 5 and the jet output elements 6 thereof. For example, the oblique angles $\alpha 1$, $\alpha 2$ can lie within the range of between 0° and 45°, in particular between approx. 5° and approx. 30°, and can be identical or different for the different individual jets, depending on requirements. In the example shown in FIGS. 2 and 3, as mentioned, the oblique angle $\alpha 1$ is inclined radially inwards in order to obtain the converging jet pattern S1 while the oblique angle $\alpha 2$ is inclined radially outwards in order to obtain the diverging jet pattern S2. In alternative embodiments, one of the two main jet directions H1, H2 is parallel to the longitudinal axis direction L of the jet disc 5 or of the shower body 1, i.e. the relevant shower jet then emerges perpendicularly at the jet disc 5 or at the output side of the shower body 1. Only the other shower jet then emerges from the jet disc 5 obliquely with respect to the normal direction thereof.

In the embodiments with the possibility of additionally producing one or more combined shower jets, the main jet direction of the individual jets of the respective combined shower jet preferably lies in the region between the first and the second main jet direction H1, H2. In corresponding realizations, a continuous capability of changing the fluid amounts which can be supplied by the user via the distributor element 20 to the first and second fluid input openings 8, 9 of the jet output elements 6, the main jet direction of the individual jets of the respective combined shower jet are changed virtually constantly or continuously or alternatively in increments between the two main jet directions H1, H2 of the first and second shower jet.

In illustrative embodiments, the user-actuated distributor element 20 is a three-way distributor valve element. Alternatively, the distributor element 20 is of another conventional type, i.e. with a plurality of valve entries and/or more than two valve exits, wherein all that is required is for supplied fluid to be able to be supplied by means of operation of the distributor element by the user either only to a first exit, only to a second exit or optionally additionally to both exits in controllable amounts.

In corresponding embodiments, the shower body 1 is an overhead shower body configured for installation on a wall or ceiling of a shower room. Alternatively, it can be configured for other types of shower applications, for example as a shower head or a shower body of a wall-mountable side shower.

In corresponding embodiments, the fluid control unit 11 includes a user-operated mixing and/or shut-off valve unit 22 of conventional design, and therefore the fluid control device 2 additionally acts as a mixer device and/or shut-off device with which two or more supplied fluids can be mixed and/or the fluid supply to one or more outlet connectors can be released or shut off. In alternative embodiments, the fluid control unit 11 consists solely of the distributor element 20.

In corresponding embodiments, the jet output elements 6, as shown in the example of FIGS. 1 to 3, are designed as V-shaped passage openings which extend through the jet disc 5 conically tapering in the output direction and respectively provide the two fluid input openings 8, 9 on the input side and a fluid output opening 23 on the output side that is shared by both the fluid input openings 8, 9. The side flanks of the V shape of the jet output elements 6 configured in this manner form flow conducting surfaces for the fluid entering through the respectively assigned fluid input opening of the two fluid input openings 8, 9 of each jet output element 6 and thereby determine the associated main jet direction H1, H2 in which the fluid entering via the relevant fluid input opening 8, 9 leaves the fluid output opening 23 as a corresponding individual jet.

Figure 4:
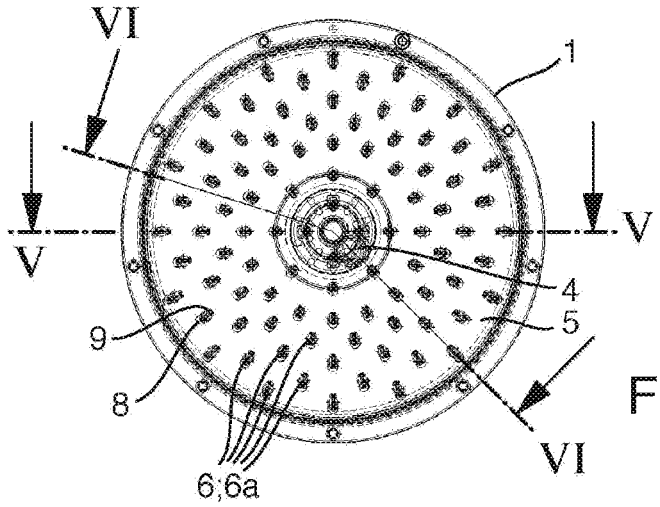
FIG. 4 shows a top view from above of a connector side of a shower body which is usable in the sanitary shower device of FIG. 1 and has a central fluid inlet configuration in an illustration which is transparent with the exception of a jet disc.
Figure 5:
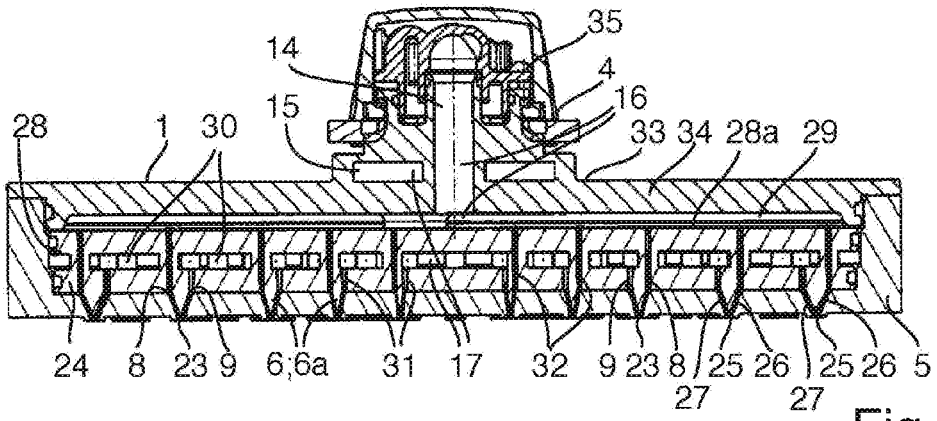
FIG. 5 shows a sectional view of the shower body along a line V-V in FIG. 4.
Figure 6:
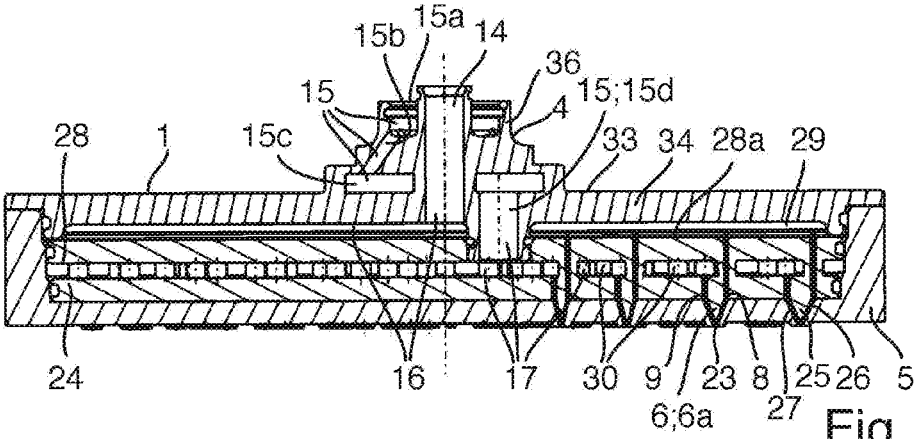
FIG. 6 shows a sectional view of the shower body along a line VI-VI in FIG. 4 with the connector body of the fluid inlet configuration removed.

FIGS. 4 to 6 show the shower body 1 in a more detailed structural realization. In FIG. 4, with the exception of the jet disc 5, all of the other shower body components are merely indicated by dashed lines and are thereby kept transparent such that the jet disc 5 can be seen with its inner side on which the fluid input openings 8, 9 of the jet output elements 6 are located. To the extent that the shower body 1 of FIGS. 4 to 6 has identical or functionally equivalent elements and properties as above with regard to the exemplary embodiment shown schematically in FIGS. 1 to 3, the same reference signs are used, and reference can also be made to this extent to the above explanations regarding the exemplary embodiment of FIGS. 1 to 3.

In corresponding embodiments, the sanitary shower device includes, as in the example of FIGS. 4 to 6, an intermediate plate 24 upstream of the jet disc 5 in the output direction, i.e. in the fluid flow direction. The intermediate plate 24 has V-shaped projections 25 corresponding to the V-shaped passage openings 6*a*, which projections extend into the V-shaped passage openings 6*a* in such a manner that they leave a respective fluid channel 26, 27 from each of the two fluid input openings 8, 9 to the fluid output opening 23.

In corresponding embodiments, the sanitary shower device, as in the example of FIGS. 4 to 6, includes a chamber plate 28 upstream of the jet disc 5, as seen in the output direction, one plate side 28*a* of the plate delimiting a first fluid chamber 29 as part of the first fluid flow path 16 and a second fluid chamber 30 being provided in the interior thereof as part of the second fluid flow path 17. The chamber plate 28 includes connecting channels 31 leading from the second fluid chamber 30 to the second fluid input openings 9 of the jet output elements 6.

In corresponding embodiments, as in the example shown in FIGS. 4 to 6, the plate side 28*a* which delimits the first fluid chamber 29 is a plate side of the chamber plate 28 facing away from the jet disc 5. In this case, the chamber plate 28 includes passage channels 32 leading from the first fluid chamber 29 through the chamber plate 28 to the first fluid input openings 8 of the jet output elements 6.

In the exemplary embodiment of FIGS. 4 to 6, the intermediate plate 24 and the chamber plate 28 are formed identically by the same plate; in alternative embodiments, they can be formed by separate plate parts, or the sanitary shower device includes only the intermediate plate 24 without the chamber plate 28 or only the chamber plate 28 without the intermediate plate 24.

In corresponding embodiments, as in the example of FIGS. 4 to 6, the fluid inlet configuration 4 of the shower body 1 is disposed on an exterior side 33 of the shower body 1 facing away from the jet disc 5. Specifically, in the exemplary embodiment of FIGS. 4 to 6, the fluid inlet configuration 4 is arranged centrally, longitudinally centrally, on the exterior side 33 of the shower body 1. When the shower body 1 is used as a shower head of an overhead shower, the exterior side 33 can specifically be a side which is at the top in the use position, i.e. upper side, of the shower head.

The shower body 1, as in the exemplary embodiment of FIGS. 4 to 6, can be closed on its side facing away from the jet disc 5 by a housing cover part 34, wherein the intermediate plate 24 and the chamber plate 28 are accommodated between the housing cover part 34 and the jet disc 5 in the shower body housing formed in this manner.

In corresponding embodiments of the sanitary shower device, the first and the second shower body inlets 14, 15 are coaxially arranged, as in the exemplary embodiment of FIGS. 4 to 6, wherein the one shower body inlet, in the example of FIGS. 4 to 6 the second shower body inlet 15, surrounds the other shower body inlet, in the example of FIGS. 4 to 6 the first shower body inlet 14, coaxially.

In the exemplary embodiment of FIGS. 4 to 6, the fluid inlet configuration 4 of the shower body 1 includes a connecting body 35 and a centrally axial connecting stub 36 which is formed on the housing cover part 34 and on which the connecting body 35 can be mounted, preferably removably. In the connecting stub 36 of the cover part 34, the first shower body inlet 14 includes a central axial bore through the cover part 34 to the first fluid chamber 29, and the second shower body inlet 15 includes an annular channel section 15*a*, one or more oblique bores 15*b*, an annular space 15*c* and a connecting bore 15*d* leading to the second fluid chamber 30 as fluidically consecutive sections of the second shower body inlet 15.

As the exemplary embodiments which are shown and the further exemplary embodiments mentioned above make clear, the invention provides a sanitary shower device in which the user, by operating the distributor element on the fluid control unit, which is spatially remote from the shower body, can optionally set different shower jets discharged by the shower body in a very comfortable manner. The sanitary shower device can be used in particular as a sanitary overhead shower device, but other applications are also possible, for example as a wall-mounted side shower or shoulder shower.

Although the invention has been described in detailed with reference to preferred embodiments, variations and modifications exist within the spirit and scope of the invention as described and defined in the following claims.

The invention claimed is:

1. A sanitary shower device, comprising:

a shower body including a fluid inlet configuration on an input side, a jet disk on an output side having a plurality of jet output elements and a fluid guidance from the fluid inlet configuration to the jet disk, wherein the jet output elements each have a first fluid input opening and a second fluid input opening and are configured to discharge fluid supplied via the first fluid input openings as a first shower jet with a first jet pattern and fluid supplied via the second fluid input openings as a second shower jet with a second jet pattern differing from the first jet pattern;

a fluid control device disposed spatially separated from the shower body, including a fluid outlet connection configuration and a user-operated fluid control unit for controlling a fluid supply to the fluid outlet connection configuration; and a fluid conduit configuration for fluid coupling of the fluid inlet configuration of the shower body to the fluid outlet connection configuration of the fluid control device;

wherein:

the fluid inlet configuration of the shower body comprises a first shower body inlet and a second shower body inlet separated from the first shower body inlet;

the fluid guidance within the shower body includes two separate fluid flow paths, of which a first fluid flow path connects the first fluid input openings with the first shower body inlet and a second fluid flow path connects the second fluid input openings with the second shower body inlet;

the fluid outlet connection configuration of the fluid control device comprises a first outlet connector and a second outlet connector separated from the first outlet connector;

the fluid conduit configuration comprises a first fluid conduit from the first outlet connector of the fluid outlet connection configuration to the first shower body inlet and a second fluid conduit from the second outlet connector of the fluid outlet connection configuration to the second shower body inlet;

the fluid control unit includes a user-operated distributor element for variable forwarding of supplied fluid to at least one of the first outlet connector and the second outlet connector; and wherein the jet output elements are designed as V-shaped passage openings which extend through the jet disk conically tapering in an output direction and respectively provide the two fluid input openings on the input side and a fluid output opening on the output side that is shared by both the fluid input openings.

2. The sanitary shower device according to claim 1, wherein the user-operated distributor element is a three-way distributor valve element.

3. The sanitary shower device according to claim 1, wherein the shower body is an overhead shower body configured for installation on a wall or ceiling of a shower room.

4. The sanitary shower device according to claim 1, wherein the fluid control device includes at least one of a mixer device, including a mixing valve unit, and a shut-off device, including a shut-off valve unit.

5. The sanitary shower device according to claim 1, further comprising an intermediate plate upstream of the jet disk in the output direction, which plate has V-shaped projections corresponding to the V-shaped passage openings, which projections extend from the two fluid input openings to the fluid output opening into the V-shaped passage openings, thereby leaving a respective fluid channel.

6. The sanitary shower device according to claim 1, further comprising a chamber plate upstream of the jet disk in the output direction, one plate side of the plate delimiting a first fluid chamber as part of the first fluid flow path and a second fluid chamber being provided in the interior thereof as part of the second fluid flow path, wherein the chamber plate includes connecting channels leading from the second fluid chamber to the second fluid input openings.

7. The sanitary shower device according to claim 6, wherein the plate side which delimits the first fluid chamber is a plate side of the chamber plate facing away from the jet disk and the chamber plate includes passage channels leading from the first fluid chamber through the chamber plate to the first fluid input openings.

8. The sanitary shower device according to claim 1, wherein the fluid inlet configuration is disposed on an exterior side of the shower body facing away from the jet disk.

9. The sanitary shower device according to claim 1, wherein the first and the second shower body inlets are coaxially arranged, wherein the one shower body inlet surrounds the other shower body inlet coaxially.

* * * * *